United States Patent [19]

Reimann et al.

[11] 3,947,297

[45] Mar. 30, 1976

[54] TREATMENT OF ALUMINUM ALLOYS

[75] Inventors: Walter H. Reimann, Xenia; Alton W. Brisbane, Yellow Springs, both of Ohio

[73] Assignee: The United States of America as represented by the Secretary of the Air Force, Washington, D.C.

[22] Filed: Apr. 18, 1973

[21] Appl. No.: 352,389

[52] U.S. Cl. ..... 148/159; 148/12.7; 148/20.6; 75/138

[51] Int. Cl.[2] ..... C21D 1/00

[58] Field of Search ..... 148/12.7, 11.5 A, 20.6, 148/159, 32.5; 75/142, 141, 139, 138

[56] References Cited

UNITED STATES PATENTS

| | | | |
|---|---|---|---|
| 2,083,576 | 6/1937 | Nock | 148/11.5 |
| 2,506,788 | 5/1950 | Hobbs | 148/12.7 |
| 2,865,796 | 12/1958 | Rosenkranz | 148/12.7 |
| 3,133,839 | 5/1964 | Thomas | 148/12.7 |
| 3,791,880 | 2/1974 | Hunsicker et al. | 148/11.5 |
| 3,836,405 | 9/1974 | Staley et al. | 148/12.7 |

OTHER PUBLICATIONS

Lyman, T. et al.; *Metals Handbook* (I), Cleveland, 1961 (ASM) p. 948.

*Primary Examiner*—Walter R. Satterfield
*Attorney, Agent, or Firm*—Joseph E. Rusz; Cedric H. Kuhn

[57] ABSTRACT

A process is provided for treating 7000 series aluminum alloys whereby their stress-corrosion resistance is greatly increased. In accordance with the process, the alloy is pre-aged, deformed at room temperature, and then subjected to two aging steps. The alloy so treated has a high resistance to stress corrosion while retaining satisfactory strength properties.

2 Claims, No Drawings

TREATMENT OF ALUMINUM ALLOYS

RIGHTS OF THE GOVERNMENT

The invention described herein may be manufactured and used by or for the Government of the United States for all governmental purposes without the payment of any royalty.

FIELD OF THE INVENTION

This invention relates to a thermomechanical process for treating aluminum alloys, particularly high strength alloys.

BACKGROUND OF THE INVENTION

Aluminum alloys are used in a variety of applications where they will not be exposed to severe temperature environments. For example, certain of the alloys are extensively employed in light weight structures, such as are present in subsonic aircraft systems, because of their high strength to weight ratio, low cost and good formability. These high strength alloys, designated in the art as 7000 series alloys, contain as their principal components a major amount of aluminum and minor amounts of magnesium and zinc.

The high strength alloys are, however, restricted in their use because of their susceptibility to stress corrosion cracking. Improvement in stress corrosion resistance has been accomplished by conventional tempering procedures, but any increase has been gained at the expense of strength. Ostermann in Metallurgical Transactions, 2, 2897–2902 (Oct. 1971) describes a thermomechanical process for treating a series 7000 aluminum alloy whereby the strength properties of the alloy are substantially improved. However, the process disclosed by Ostermann does not result in any substantial increase in the resistance of the alloy to stress corrosion.

The principal object of this invention, therefore, is to provide a process for treating 7000 series aluminum alloys so as to increase materially their stress corrosion resistance without decreasing their strength properties to any substantial degree. Other objects and advantages of the invention will become apparent to those skilled in the art upon consideration of the accompanying disclosure.

SUMMARY OF THE INVENTION

The present invention resides in a process for thermomechanically treating a 7000 series aluminum alloy that is characterized by subjecting the alloy, after preaging and cold working, to a series of two final aging steps. It has been found that as a result of the second final aging step an alloy is produced that unexpectedly has a greatly increased resistance to corrosion resistance as compared to conventional heat treated alloys. Furthermore, the alloy possesses strength properties that are comparable to those of commercial alloys of the 7000 series. If the second final aging step is omitted, the alloy obtained has excellent strength properties, but its use is still limited by its susceptibility to stress corrosion cracking.

In a specific embodiment, the process of this invention comprises the steps of (1) heating the alloy in a salt bath (aqueous solution of sodium chloride) for about 1 hour at a temperature of about 870°F; (2) removing the alloy from the salt bath and immediately quenching same by immersing in a room temperature water bath; (3) soaking or pre-aging the quenched alloy in an oil bath for about 1 to 2 hours at a temperature ranging from about 212° to 250°F; (4) removing the alloy from the oil bath and cold working the alloy so as to deform same by about 5 to 15 percent; (5) soaking or aging the worked alloy in an air furnace for about 10 to 25 hours at a temperature ranging from about 240° to 260°F; (6) air cooling the alloy to room temperature; (7) soaking or aging the cooled alloy in an air furnace for about 5 to 6 hours at a temperature ranging from about 330° to 350°F; and (8) air cooling the alloy to room temperature. In a preferred embodiment, the alloy is subjected to a 10 percent cold work (step 4); the worked alloy is aged for 16 hours at 250°F (step 5); and the second of the final aging steps (step 7) is conducted at 330°F for 6 hours.

The salt bath and the oil bath are the same as those that are conventionally used in the treatment of metals and alloys. The cold working of the alloy can be accomplished by any suitable means, such as by unidirectional tension and compression, swaging, and rolling a conventional mill. Excellent results have been obtained by utilization of each of these working means.

Aluminum alloys of the 7000 series can be broadly referred to as Al-Mg-Zn alloys. More specifically, these alloys generally have the following composition:

| Element | | Weight Percent |
|---|---|---|
| Aluminum | | Remainder |
| Magnesium | | 0.1–3.7 |
| Zinc | | 0.8–8.2 |
| Copper | | 0–2.8 |
| Zirconium | | 0–0.15 |
| Silicon | | 0.50 max. |
| Manganese | | 0–0.4 |
| Chromium | | 0–0.4 |
| Iron | | 0.70 max. |
| Titanium | | 0.20 max. |
| Others: | Each | 0.05 max. |
| | Total | 0.15 max. |

A more complete understanding of the invention can be obtained by referring to the following illustrative example which is not intended, however, to be unduly limitative of the invention.

EXAMPLE

Runs were conducted in which specimens of commerical grade 7075 aluminum (7000 series) were treated in accordance with the process of this invention. The shape of the specimens used was dictated by the mechanical property tests to which they were to be subsequently subjected. Thus, specimens of a 1 inch diameter rods were treated for use in obtaining tensile data while 4 × 4 × 4 inch blocks were treated for use in stress corrosion and fracture toughness tests. The general composition for 7075 aluminum as well as the specific compositions for the specimens used are shown below in Table I.

TABLE I

| Element | Specification Limits for 7075 | 4"×4"×4"[1] Block | 1"Diameter[1] Rod |
|---|---|---|---|
| Aluminum | Remainder | Remainder | Remainder |
| Magnesium | 2.10–2.90 | 2.50 | 2.60 |
| Zinc | 5.10–6.10 | 5.80 | 6.0 |
| Copper | 1.20–2.00 | 1.60 | 1.70 |
| Silicon | 0.50 max. | 0.09 | 0.14 |
| Manganese | 0.30 max. | 0.021 | 0.047 |
| Chromium | 0.18–0.40 | 0.21 | 0.20 |

TABLE I-continued

| Element | Specification Limits for 7075 | 4"×4"×4"[1] Block | 1"Diameter[1] Rod |
|---|---|---|---|
| Iron | 0.70 max. | 0.12 | 0.20 |
| Titanium | 0.20 max. | 0.045 | 0.038 |
| Other: Each | 0.05 max. | | |
| Total | 0.15 max. | | |

[1]Determined by spectrographic analysis.

Initially the specimens were solution heat treated in a salt bath for 1 hour at 870°F. They were then withdrawn from the bath and immediately quenched by immersion in cold water. Thereafter, the specimens were pre-aged by soaking for 1 hour in an oil bath at 212°F. After removal from the oil bath, the specimens were 10 percent cold worked. In the case of the 4 × 4 × 4 inch block specimens, cold working was accomplished by compression, using a $3 \times 10^6$ pound Baldwin machine. The 1 inch diameter rod specimens were cold worked by swaging. After the cold working, the specimens were aged by heating in an air furnace for 16 hours at 250°F. The specimens were then air cooled to room temperature after which they were further aged by heating in an air furnace for 6 hours at 330°F. At the end of the 6-hour period, the specimens were air cooled to room temperature.

Control runs were conducted in which specimens, as described above, were treated in accordance with the foregoing procedure except for their final aging. In these runs the specimens were not subjected to the second of the final aging steps, i.e., they were not heated for 6 hours at 330°F.

The specimens were thereafter tested for certain mechanical properties. The results of these tests are shown below in Table II. Also, included in the table are typical mechanical properties of 7075 aluminum alloys obtained by conventional heat treatments (T-6 and T-73).

TABLE II

| Property | T-6 | T-73 | Control Specimens | Invention Specimens |
|---|---|---|---|---|
| 0.2% yield strength, ksi[1] | 72 | 63 | 82.6 | 70 |
| Ultimate tensile strengths, ksi[1] | 83 | 73 | 87.1 | 79.3 |
| Elongation, % in 1"[1] | 11 | 13 | 14.6 | 19.0 |
| Reduction in area, % | 32 | 43 | 31.9 | 41.9 |
| Stress Corrosion, ksi[2] | 10 | 45 | 15 | >35 |
| Fracture toughness,[3] ksi, in. | 28 | 32 | 37 | 35 |

[1]Determined by method of ASTM E206–66.
[2]Determined by ASTM recommended practice - G01.06.02, T. G. 1.
[3]Determined by method of ASTM E399.

From the data in the foregoing table, it is seen that the specimens treated in accordance with the process of this invention are much more resistant to corrosion resistance than T-6 or the control specimens. Furthermore, the tensile properties of the invention specimens are comparable to those of T-6. While T-73 has a high resistance to corrosion resistance, its tensile properties are low as compared to T-6 or the invention specimens. The control specimens have very high tensile properties, but like T-6 the resistance to stress corrosion is low. Thus, these data demonstrate the criticality of the two step final aging procedure followed in the practice of the present process in obtaining a high strength 7000 series aluminum alloy that is resistant to stress corrosion cracking.

As will be evident to those skilled in the art, various modifications of this invention can be made or followed in view of the foregoing disclosure without departing from the spirit or scope of the invention.

We claim:

1. A process for treating an aluminum alloy of the 7000 series which comprises the steps of:

a. heating the alloy in a salt bath for about 1 hour at a temperature of about 870°F;
b. removing the heated alloy from the salt bath and immediately quenching same by immersing in a room temperature water bath;
c. soaking the quenched alloy in an oil bath for about 1 to 2 hours at a temperature ranging from about 212° to 250°F;
d. removing the alloy from the oil bath and cold working the alloy so as to deform same by about 5 to 15 percent;
e. aging the worked alloy by heating same in an air furnace for about 10 to 25 hours at a temperature ranging from about 240° to 260°F;
f. air cooling the alloy to room temperature;
g. further aging the alloy by heating same in an air furnace for about 5 to 6 hours at a temperature ranging from about 330° to 350°F; and
h. air cooling the alloy to room temperature.

2. The process according to claim 1 in which the alloy removed from the oil bath is cold worked so as to deform same by about 10 percent; the worked alloy is aged by heating in an air furnace for 16 hours at 250°F, and after air cooling the alloy is further aged by heating in an air furnace for 6 hours at 330°F.

* * * * *